United States Patent [19]

Fuchs

[11] Patent Number: 4,861,213

[45] Date of Patent: Aug. 29, 1989

[54] STACKING DEVICE FOR THE DISPLACEMENT OF SHEETS

[76] Inventor: Werner K. H. Fuchs, Sedlmayrster. 14, D 8 München 19, Fed. Rep. of Germany

[21] Appl. No.: 62,311

[22] Filed: Apr. 27, 1987

Related U.S. Application Data

[63] Continuation of Ser. No. 783,960, Oct. 4, 1985, abandoned.

[30] Foreign Application Priority Data

Jun. 5, 1985 [DE] Fed. Rep. of Germany ..... 3520246

[51] Int. Cl.[4] ..... B65G 57/08; B65H 33/08

[52] U.S. Cl. ..... 414/791.2; 198/379; 211/50; 271/185; 271/207; 271/298; 271/303; 271/305; 414/794.8; 414/923

[58] Field of Search ..... 198/374, 379, 401, 416; 206/449; 211/50, 56; 271/184, 185, 207, 279, 282, 298, 303, 305; 414/54, 86, 97

[56] References Cited

U.S. PATENT DOCUMENTS

| | | | |
|---|---|---|---|
| 1,532,436 | 4/1925 | Musil | 206/449 |
| 2,114,927 | 4/1938 | Krell | 198/374 |
| 2,966,156 | 12/1960 | Scholfield | 206/449 X |
| 3,543,926 | 12/1970 | Campbell | 271/279 X |
| 3,860,127 | 1/1975 | Fassman | 414/54 |
| 3,946,879 | 3/1976 | Jensen | 414/54 |
| 3,979,115 | 9/1976 | Brukner et al. | 271/227 X |
| 4,015,842 | 4/1977 | Perry | 414/54 X |
| 4,030,724 | 6/1977 | Goodwin | 271/295 |
| 4,157,176 | 6/1979 | Kaiser et al. | 271/279 X |
| 4,314,644 | 2/1982 | Stocker | 271/184 X |
| 4,445,679 | 5/1984 | Bay | 271/184 X |

FOREIGN PATENT DOCUMENTS

| | | | |
|---|---|---|---|
| 160565 | 5/1905 | Fed. Rep. of Germany | 211/50 |
| 561015 | 5/1933 | Fed. Rep. of Germany . | |
| 6493419 | 2/1970 | Fed. Rep. of Germany . | |
| 115522 | 9/1980 | Japan | 198/401 |

*Primary Examiner*—Frank E. Werner
*Assistant Examiner*—Janice Krizek

[57] ABSTRACT

A stacking device for sheets emerging from an ejection opening (for example, a photocopying machine), whereby the sheets are alternately distributed and stacked in several positions relatively displaced to each other. The relatively displaced stacks are formed by a one-sided engagement of the sheets to be stacked by a switchable turning mechanism controlled by a steering device.

12 Claims, 4 Drawing Sheets

STACKING DEVICE FOR THE DISPLACEMENT OF SHEETS

CROSS REFERENCES TO RELATED APPLICATIONS

This application is a continuation of my prior copending application Ser. No. 06/783,960, filed Oct. 4, 1985, now abandoned.

BACKGROUND OF THE INVENTION

This invention relates to a device for the relative displaced stacking of sheets and bundles of sheets. A relative displaced stacking of sheets is desirable for collating and, for example, for photocopying machines in order to clearly separate various copying assignments or sequences.

Prior art references which were considered are DE-OS 24 44 206, US-PS 4,236,856 and DE-GM 69 43 419. These prior art references, which do not anticipate the features of the present invention, are only of interest because they also describe devices which serve to solve comparable tasks.

There are several problems connected with previous distributing and stacking devices. One problem, for example, regarding the first of the above-mentioned prior art references is that the described mechanism is hardly suited to stack single sheets in a definite relatively displaced position, since the sheets bumping against the pin projecting from a slide tend to bounce and turn in an uncontrollable manner or, in the case of thin sheets, could roll up and flutter away on the long way to the collecting bin. Another disadvantage is the size of the machine necessitated by the space needed for the chute.

The devices described in the other two above-mentioned prior art references require a relatively large construction and expense due to the motor and/or cam drive They are less suitable for the displacement of singly ejected sheets, since in the one case the huge reciprocating jogger and, in the other case, the relatively heavy pair of rollers would have to be moved with each single sheet to be displaced, which requires comparatively large amounts of power and energy.

SUMMARY OF THE INVENTION

One aim of the present invention is to achieve a simpler, cheaper, and space-saving means for the relative displaced stacking of sheets (for example, copies) or bundles.

An object of the present invention is to provide a new, useful, and very advantageous device for the relative displacement of sheets. For this a gib is positioned at a slot or feed opening for the sheets in back of said opening under the emerging sheets in the direction of movement, at least one anchor located above the gib and positioned to one side of the middle of the sheets, so that the emerging sheets pass between the gib and the anchor, a steering mechanism connected with the anchor, and a storage tray mounted under the gib, the tray provided with relatively displaced compartments to accommodate the sheets displaced by the anchor.

In accordance with an advantageous development of the present invention, said steering mechanism comprises at least one magnet installed on the gib for said anchor, an electrical scanning device mounted at the ejection opening for detecting the ends of the sheets, and a switching means electrically connected to said magnet and the scanning device serving to alternately energize the magnet, whereby said anchor grasps the emerging sheet almost vertically and punctiform on the top surface at the gib and forms an axis of rotation for the sheet enabling it to arrive at the storage tray in a position corresponding to its rotary motion.

In accordance with another advantageous development of the invention, two anchors are attached above said gib and allocated to both edges of the emerged sheet, and the magnets with the steering mechanism are mounted in the gib.

A further object of the present invention is the storage tray characterized by its special features. Up to three relatively displaced stacks can be formed on it in an advantageous manner.

Other objects, features, and advantages of the present invention become apparent from the subsequent description, from the disclosure teaching of the principles of the invention, and from the appended claims taken in connection with the accompanying drawings.

The advantages of the invention are the simple, space-saving construction, the resulting savings in material, weight, and costs, as well as the great reliability attainable by controlled, definite sheet movement. In addition, the short distance the sheet has to travel makes it possible to achieve higher productivity when displacing and stacking. The device works wear-free and in its simplest construction consists of only a few parts.

BRIEF DESCRIPTION OF THE DRAWINGS

The invention is represented in the following embodiments and shown in.

DESCRIPTION OF THE PREFERRED EMBODIMENTS

Figure 1:
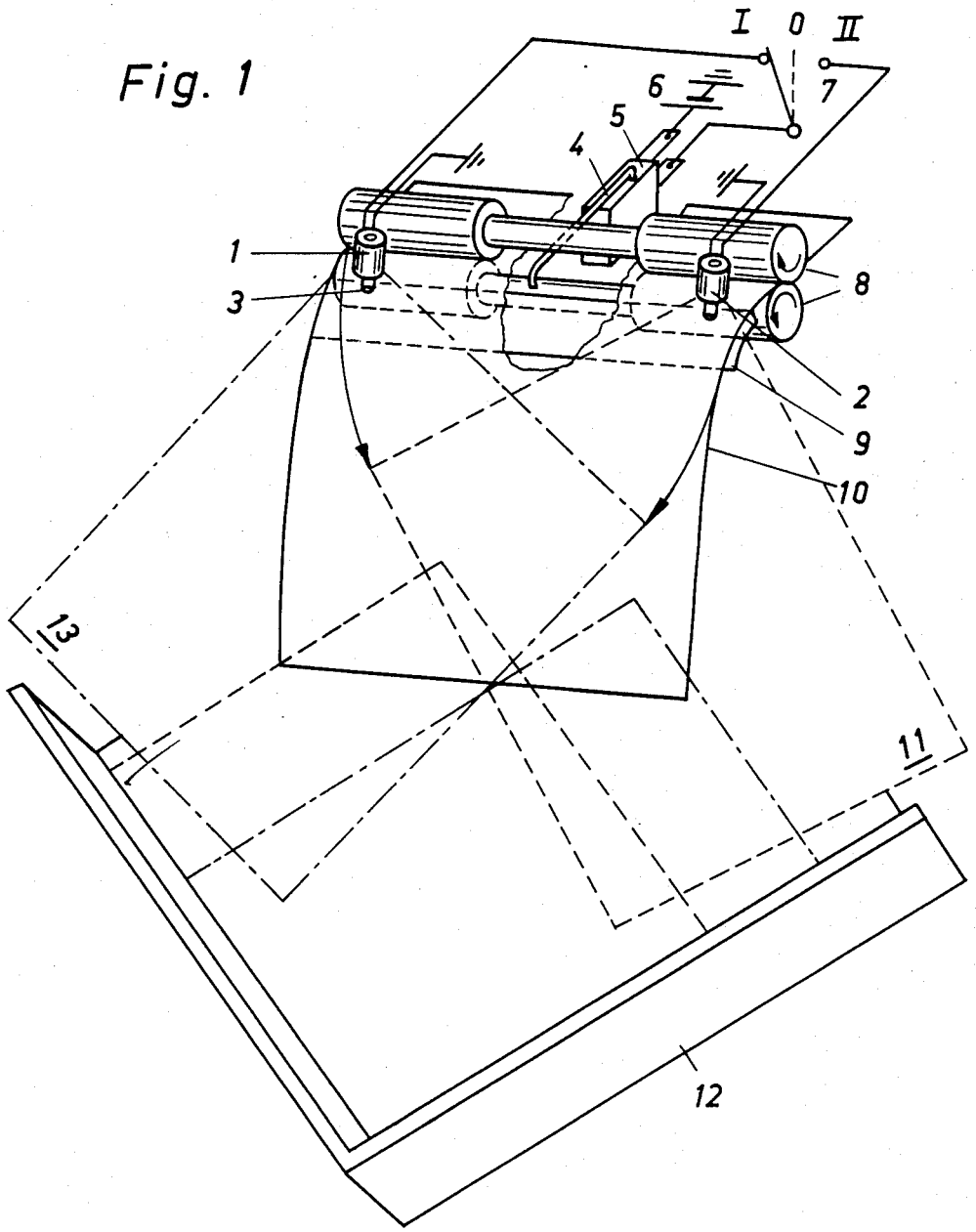
FIG. 1 a total view of the stacking device with two stacks relatively displaced at a 90 degree angle.
Figure 4:
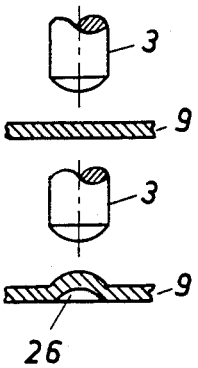
FIG. 4 an enlarged drawing of a practical spherical anchor cap and an anchor counterpart 26 on a gib 9.

FIG. 1 is a view looking toward the feed slot and/or rollers 8 of a feed mechanism of a (copying) machine and the stacking tray 12. A driving mechanism for the feed rollers was not drawn. Above a ledge or gib 9 which was fastened in the direction the sheet moves behind the rollers 8 and under the emerging sheets 10, there are small electromagnets 1, 2 arranged above the right and left edges of the sheet 10. The magnet anchors 3 are made of thin pins rounded on the bottom and normally drawn up by springs (not shown) so that they do not contact the emerging sheets 10. A microswitch 5 is mounted in such a way that it scans the undersides of the sheets 10 with its control lever or feeler 4. In doing so, the feeler 4 extends into the grooves of the feed rollers 8. In order to show this clearly a piece of the sheet 10 was torn out. The microswitch 5, which is connected with the magnets 1 and 2, is switched off when and as long as there is a sheet 10 over its feeler 4. Otherwise, the feeler 4 swings into the groove of the top roller 8 so that the switch 5 is closed. The movable switch contact of a change-over switch 7 is, in series with the microswitch 5, connected to a power source 6, the negative pole of which lies on the mass. The magnets 1, 2 which, on the one hand, also have contact with the mass are connected on the other hand with the contacts I and II of the change-over switch 7. The receiving or stacking tray 12 is placed directly behind the rollers 8 and/or the gib 9 beneath the emerging sheets 10 in an inclined position and can be equipped with a conventional vibrating or jolting device.

The sheet 10 passes between the rollers 8 turning in the direction of the arrow and goes over the gib 9 without being influenced by the magnets 1, 2 arranged above. At the same time, the feeler or control lever 4 stays under the sheet 10 and the microswitch 5 remains open. As soon as the end of the sheet 10 has passed through the rollers 8, the feeler 4 springs into the groove of the upper roller 8 which the sheet has cleared, so that the microswitch 5 is closed and current flows from the power source 6 to the electromagnet 1 via the change-over switch 7. Consequently, the magnet's anchor 3 pushes the sheet 10 released by the rollers 8 punctiform and almost vertically to the top side of the sheet onto the ledge or gib 9 which is a support for the anchor 3. This causes the sheet 10 to rotate around the magnet anchor 3's point of contact acting as axis of rotation and onto the gib 9 until the sheet's center of gravity lies under the anchor 3. The sheet 10 then assumes the angular position of the sheet 13 indicated by a dot-dash line. In this way an undesirable swinging caused by the sliding of the sheet 10 on the gib 9 is avoided. The following sheet 10 pushes the feeler 4 into the groove of the lower roller 8 again so that the microswitch 5 switches off the magnet 1. As a result, the released sheet 13 assumes the position on the storage tray 12 illustrated by a dot-dash line—corresponding to its angular initial position. If the change-over switch 7 is changed into position II, the magnet 2 will then form the second displaced stack at a 90 degree angle on the table 12 in the position 11 indicated by a broken line. For energizing the magnet a current impulse of a certain duration is advisable so that the sheets 13, 11 are not held unduly long by the magnets 1, 2.

Figure 2:
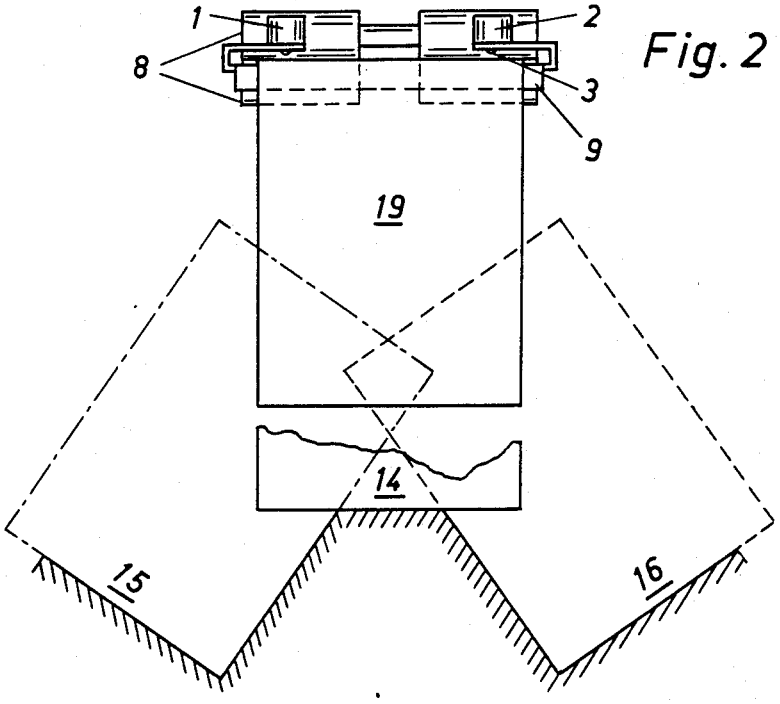
FIG. 2 a view of the stacking device with which two or three fan-like relatively displaced stacks are formed FIG. 3 an arrangement with only one magnet which forms two relatively displaced stacks at a 90 degree angle.

FIG. 2 shows a schematic design with a view toward the feed opening and three fan-like relatively displaced stacks of sheets. In the direction the sheet moves (i.e., toward the viewer), behind the exit rollers 8, the gib 9 is mounted which, together with the bent angles and the small electromagnets 1 and 2 fixed on them, forms a partial frame around the feed opening. Here too, the magnet anchors 3 have rounded ball-like caps.

If neither of the two magnets 1 and 2 is actuated, the sheets 19 emerge straightout of the feed opening into the middle position of the sheet 14. Magnet 1 forms the fan-like displaced position of sheet 15 shown by a dot-dash line, and magnet 2 creates the position of sheet 16 shown by a broken line. This demonstrates that with one magnet two stacks can be formed and with two magnets three stacks. A smaller angular displacement of sheets 15, 16 can be achieved by moving the magnets 1 and 2 closer together toward the middle. A curve-formed stacking tray or a tray with compartments arranged on the sides can also be advantageous for stacking or sorting.

Figure 3A:
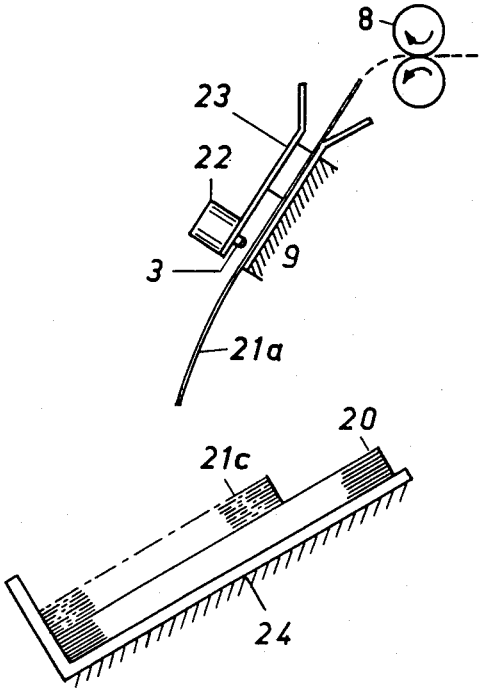
FIG. 3*a* a side view of FIG. 3.
Figure 3:
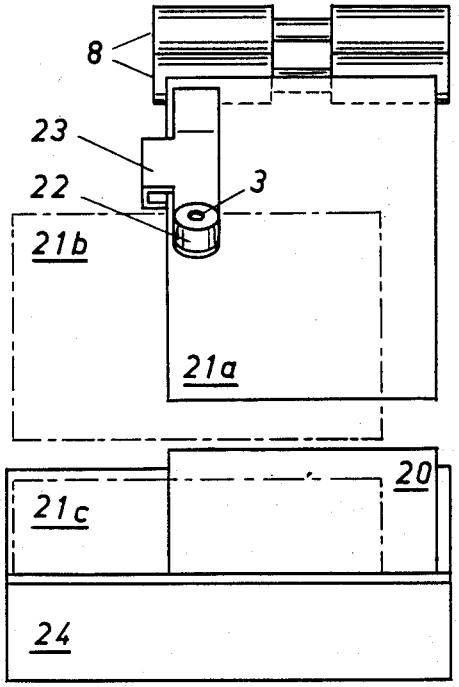

In FIG. 3 a small electromagnet 22 creates the sheet position 21*c* indicated by a dot-dash line that is relatively displaced at a 90 degree angle from the emerging sheet 20 which is not influenced by the magnet. On the edge at about the middle length of sheet 21*a* emerging through the rollers 8, the magnet 22 is fastened to an offset angle 23, so that when sheet 21*a* is engaged by the anchor 3 and pressed onto the gib 9 it can freely turn into the position of sheet 21*b* indicated by dot-dash lines. Following this, sheet 21*b*, which has been released by the magnet 22, 3 assumes the position of sheet 21*c* illustrated below it on the storage tray 24. The electrical control of magnet 22 can be accomplished the same way as is shown and described in FIG. 1.

Figure 5:
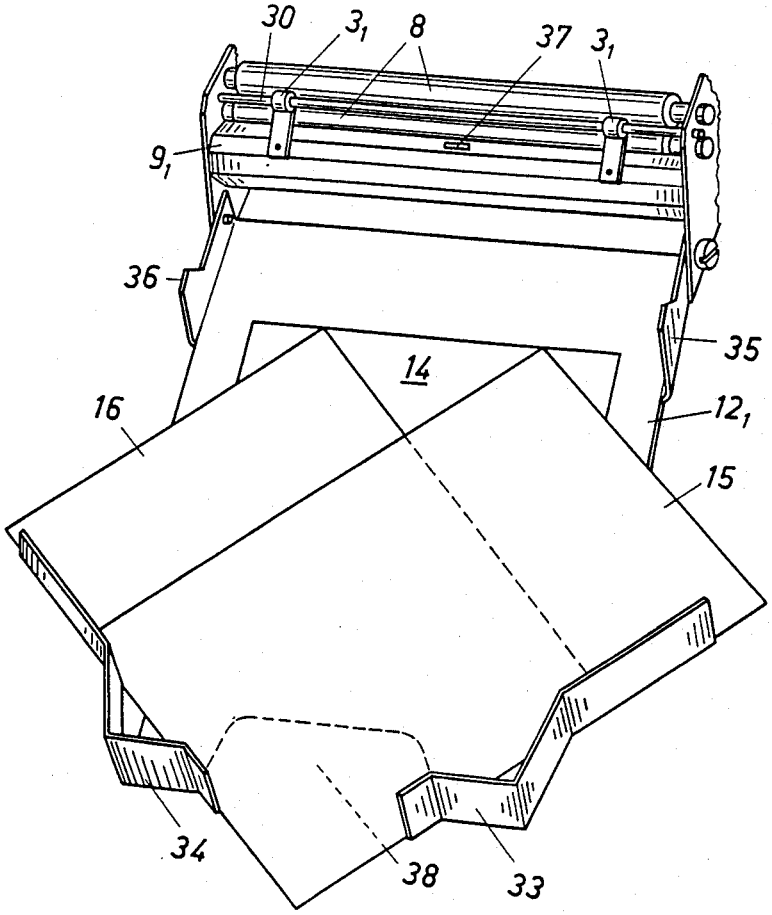
FIG. 5 a view of the actual stacking device.

FIG. 5 shows, in the direction the paper moves, a gib $9_1$, over which the emerging sheets pass, mounted behind and parallel to the exit rollers 8. Above the gib $9_1$ and likewise parallel to the exit rollers 8, an axis 30 is fixed on which two small lugs or tongues $3_1$ are movably positioned. They are made of ferromagnetic material (for example, ferrotype) and pass over the edges of the emerging sheets with their free ends. Wart-like punch marks in the small lugs $3_1$ mark the pivotal points for the sheets to be displaced. Under the lugs $3_1$, in the gib $9_1$, two electromagnets (not shown) have been installed which influence the lugs $3_1$ magnetically (i.e., here they can alternately attract them). For practical purposes, the lugs $3_1$ in this case are made of a 0.5 mm thick and 8 mm wide metal strip. Sheet metal strips of 0.2–1 mm thickness are also suitable. The gib 9, $9_1$, for example, is only 30 mm wide. Under the gib $9_1$ a specially designed downward sloping receiving or storage tray $12_1$ is fastened.

at the lower end the tray has two V-shaped abutments 33, 34 which, as the drawing shows, are relatively displaced to each other symmetrically at a 90 degree angle so that the sheets 14 emerging straight can be fed into the V-shapes 33, 34. In the middle between the ledges 33, 34 a recess 38 for extracting the sheets is provided. For practical purposes, the storage tray $12_1$ is constructed in such a way that the top edge of sheet 14 is aligned with the top corners of sheets 15 and 16. On the upper right and left sides of the tray $12_1$ stops 35, 36 are provided to limit the angle of traverse or twist of sheets 15, 16 deflected by the lugs $3_1$ and thus promote a more rapid operation of the stacking device.

Up to three fan-like relatively displaced stacks can be formed on the tray $12_1$: The first stack is formed when the sheets emerge unengaged straight into the position of sheet 14 and are held within the V-shaped abutments 33, 34. Sheets 15 and 16, which are displaced by the lugs $3_1$, show two further stacking positions which are relatively displaced to each other at a 90 degree angle.

In a practical further development, the electric steering control as well as a photoelectric sheetscanning device 37 (instead of a feeder 4) for recognizing the ends of the sheets and energizing the magnets is also integrated and/or mounted in the gib $9_1$, along with the already-mentioned electromagnets 1 and 2.

Figure 6:
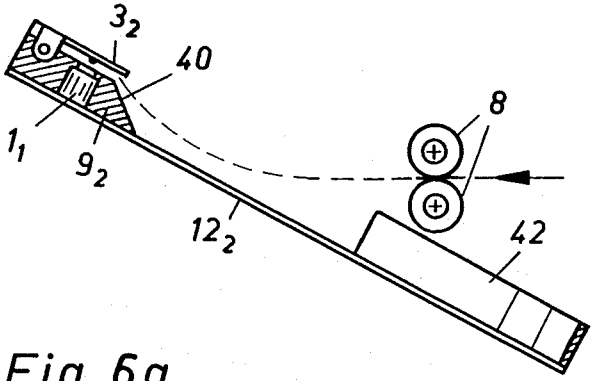
FIG. 6 a schematic representation of a stacking device with the storage tray in an upward slope.
Figure 6A:
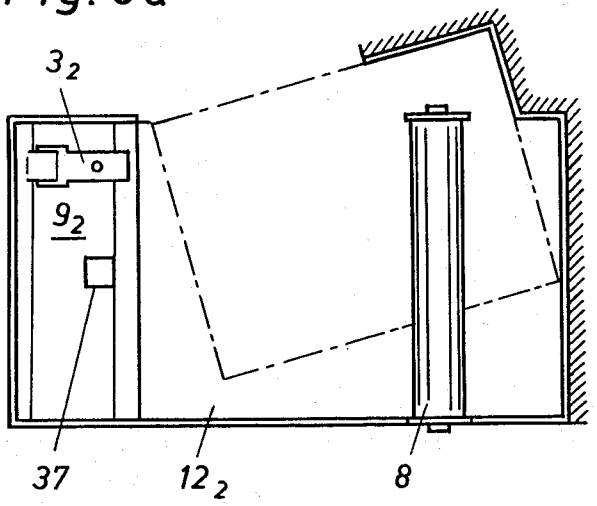
FIG. 6*a* a top plan view of FIG. 6.

FIGS. 6 and 6*a* show a schematic side view and top plan view of a stacking device in accordance with the present invention mounted on an upwardly sloping storage tray $12_2$. At its top this tray has at least one magnet $1_1$ or a gib $9_2$ with an inclined ramp 40 in which the small electromagnet $1_1$ with the tiny anchor plate $3_2$ above it is mounted. Between the magnet $1_1$ and its anchor plate $3_2$ there is (when inactive) an air gap created, for example, by a spring (not shown). Mounted in the gib $9_2$, along with the magnet $1_1$, is a non-contacting sheet scanning device 37 for energizing the magnet. This device, as is shown in FIG. 5 for example, can be a light barrier. At the lower end the storage tray $12_2$ has been designed with abutments 42 in such a way that here, too, as has been described above, the sheets can be alternately stacked either straight or in a fan-like relatively displaced position. A sheet passing through the rotating exit rollers 8 up the incline in the direction indicated by a broken line is pushed over the ramp 40 into the open air gap under the anchor plate $3_2$ and simultaneously over the photoscanning device 37. After the sheet has been released by the exit rollers 8, the mode of operation of this stacking device is the same as has already been described above.

Figure 7:
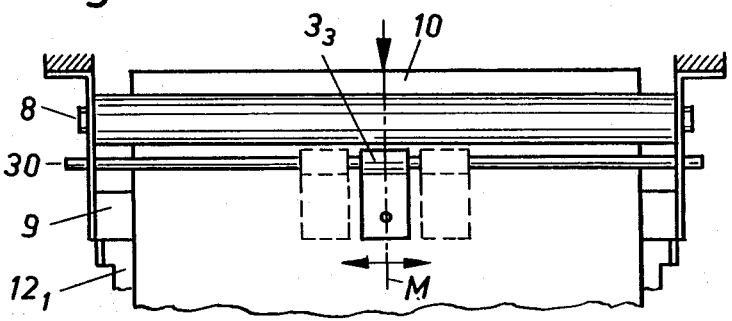
FIG. 7 a top plan view of a stacking device with an adjustable anchor.

FIG. 7 is a view from above of a stacking device having only one anchor $3_3$ located on the axle 30 and is thus able to form at least three relatively displaced stacks. The axle 30 and a gib or ledge 9 are arranged the same as in FIG. 5. The anchor $3_3$ lies with its free end on the ledge 9 or on the emerging sheet 10 and was mounted so that, with the help of an operating or control device 30, the anchor is adjustable left or right (in the direction of the arrow) above the middle M of the sheet 10, whereby with the anchor the rotation axis for the free-falling sheets is adjustable, said axis passing almost vertically through the anchor. In this case the anchor $3_3$ is, for example, of a relatively heavier construction so that even without a magnet it can transmit sufficient eccentric force to the sheets 10 in the case of axial displacements. Under the gib 9, for example, the same storage tray $12_1$ was fastened which is shown in its entirety in FIG. 5. If the anchor $3_3$ is in the position shown, above the middle line M of the emerging sheets 10, these sheets will not be displaced. If, on the other hand, the anchor $3_3$ is located to the left or right of the middle line M, then the sheets 10 will arrive at the desired relatively displaced positions, whereby the sheets 10 slide turning around the anchor $3_3$.

Figure 8:
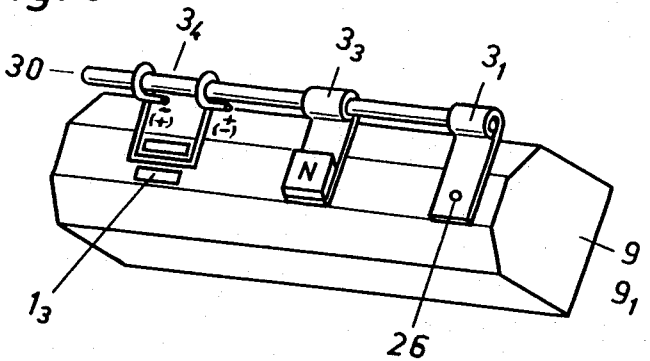
FIG. 8 a view of various advantageous anchor designs.

FIG. 8 shows a piece of a gib 9 and/or $9_1$ above which three different suitable anchors $3_1$, $3_3$ and $3_4$ are practically mounted on an axle 30. The anchor $3_1$, for example, is made of ferromagnetic material (soft iron) as is shown in FIG. 5, is coiled on the axle 30 and on the other, free end is provided with a wart 26 made by a center punch enabling the anchor to lie punctiform on the gib 9 or $9_1$. The anchor $3_3$ used in FIG. 7, which is of a heavier construction, can also support a permanent magnet N, whereby the bearing pressure on the gib 9, $9_1$ can be influenced. The anchor $3_4$ is made of insulated wire bent into a U-shape and arranged with its lower leg between the poles of a permanent magnet $1_3$ which was built into the gib $9_1$. The ends of the U-frame are connected with a power source (not shown) so that the frame $3_4$ can be alternately attracted or also rejected by the magnet $1_3$.

Anchor $3_4$ is suited for an especially fast-moving stacking device meant to displace and stack a multiplicity of sheets per second. In this case, the kinetic energy of the emerging sheets is more effective than their weight for displacing them.

In a further advantageous development, the magnets $1_1$, $1_3$ are adjustably mounted in the gib $9_2$, $9_1$ (not shown). By influencing the anchor weight, the frictional coefficient, or the magnetic force, thicker types of sheets or bundles can also be relatively displaced.

I wish it to be understood that I do not desire to be limited to the exact details of construction shown and described, for obvious modifications will occur to a person skilled in the art.

What is claimed is:

1. A stacking device for the displacement of sheets comprising:

a feed slot for supplying free-falling sheets to the stacking device, an inclined storage tray for the sheets fastened behind said feed slot in the direction the sheets are moving in order to accommodate fan-like relatively displaced sheets, a ledge fastened between the feed slot and the storage tray beneath the free-falling sheets emerging from said slot, at least one anchor mounted above said ledge and arranged to one side of the middle of the sheets emerging from said slot so that the sheets pass between the ledge and the anchor on the way to the storage tray, at least one magnet mounted on the ledge for said anchor, an electrical scanning device for detecting the sheet ends emerging from said feed slot, and a switching means electrically connected with said scanning device and the magnet and serving to alternately energize the magnet, whereby said anchor presses the free-falling sheet onto said ledge causing rotation of said free-falling sheet about an axis passing vertically through the anchor, so that the sheet arrives at said storage tray in a position corresponding to its rotary motion.

2. Stacking device as claimed in claim 1, wherein at least two anchors are located above said ledge and at both edges of the emerging sheet, and at least two electromagnets are installed for the anchors and connected with said switching means as well as with the scanning device.

3. Stacking device as claimed in claim 1, wherein said anchor has a spherical cap.

4. Stacking device as claimed in claim 1, wherein said magnet is built into said ledge and said anchor is a tongue.

5. Stacking device as claimed in claim 1, wherein said magnet is adjustably positioned on said ledge.

6. Stacking device as claimed in claim 1, wherein said magnet and said electrical scanning device are integrated in said ledge.

7. Stacking device as claimed in claim 1, wherein said ledge and said magnet are fastened onto said inclined storage tray.

8. Stacking device as claimed in claim 1, wherein said storage tray has at least two abutments at the lower end of said tray which are V-shaped and relatively displaced at 90 degrees to each other so that rotated sheets are accomodated in the V-shapes, and a recess provided in the middle between said abutments for accomodating sheets emerging unrotated from the feed slot.

9. Stacking device as claimed in claim 1, wherein said anchor includes a permanent magnet.

10. Stacking device as claimed in claim 1, wherein said anchor includes a U-shaped frame electrically connected with said scanning device, and said magnet comprises a permanent magnet.

11. A stacking device for the displacement of sheets comprising:

a feed slot for supplying sheets to the stacking device, a storage tray for the sheets fastened behind said feed slot in the direction the sheets are moving in order to accommodate relatively displaced sheets, a ledge fastened between the feed slot and the storage tray beneath the sheets emerging from said slot, at least one anchor mounted above said ledge so that the sheets emerging from said feed slot pass between the ledge and the anchor on the way to the storage tray, and a control means connected with said anchor so that the anchor is adjustable left and right above the emerging sheets, whereby said anchor presses the sheet onto said ledge causing rotation of said sheet about an axis passing vertically through the anchor so that the sheet arrives at said storage tray in a position corresponding to its rotary motion.

12. A stacking device for the displacement of sheets comprising:

a feed slot for supplying sheets to the stacking device, a storage tray for the sheets fastened behind said feed slot in the direction the sheets are moving, having a first compartment for sheets emerging straight on, a second compartment for sheets displaced to the right, and a third compartment for sheets displaced to the left, a ledge fastened between the feed slot and the storage tray beneath the sheets emerging from said slot, at least one anchor mounted above said ledge so that sheets emerging from said feed slot pass between the ledge and the anchor on the way to the storage tray, and a control means connected with said anchor so that the anchor is adjustable above the middle and to the right and left of the middle of the emerging sheets for selecting said compartments in said storage tray, whereby the sheets passing directly beneath said anchor move straight on to the first compartment, and the sheets passing beneath the anchor adjusted to the right and left of the sheet center pass into a selected second and third compartment of said storage tray in a position corresponding to their rotary motion which is produced by the anchor pressing the sheet onto the ledge causing rotation about an axis passing vertically through the anchor.

* * * * *